US007926622B2

(12) United States Patent
Henneau

(10) Patent No.: US 7,926,622 B2
(45) Date of Patent: Apr. 19, 2011

(54) LIFT CABLE SLACK MONITORING DEVICE AND METHOD

(75) Inventor: Philippe Henneau, Zurich (CH)

(73) Assignee: Inventio AG, Hergiswil NW (CH)

( * ) Notice: Subject to any disclaimer, the term of this patent is extended or adjusted under 35 U.S.C. 154(b) by 616 days.

(21) Appl. No.: 12/024,185

(22) Filed: Feb. 1, 2008

(65) Prior Publication Data

US 2008/0185232 A1 Aug. 7, 2008

(30) Foreign Application Priority Data

Feb. 2, 2007 (EP) ..... 07101660

(51) Int. Cl.
*B66B 1/34* (2006.01)

(52) U.S. Cl. ..... 187/393

(58) Field of Classification Search ..... 187/254, 187/391–393, 401, 292; 177/132, 142, 147; 73/1.09, 1.13, 1.15, 763, 783, 796, 811
See application file for complete search history.

(56) References Cited

U.S. PATENT DOCUMENTS

| | | | | |
|---|---|---|---|---|
| 3,323,606 | A * | 6/1967 | Bruns et al. | 177/147 |
| 4,467,895 | A * | 8/1984 | Smith et al. | 187/391 |
| 4,766,977 | A * | 8/1988 | Yamasaki | 187/392 |
| 5,156,239 | A * | 10/1992 | Ericson et al. | 187/254 |
| 6,123,176 | A * | 9/2000 | O'Donnell et al. | 187/393 |
| 6,305,503 | B1 * | 10/2001 | Suzuki et al. | 187/393 |
| 6,488,128 | B1 * | 12/2002 | Slabinski | 187/393 |
| 6,715,587 | B2 * | 4/2004 | Sittler et al. | 187/401 |
| 7,784,589 | B2 * | 8/2010 | Fischer | 187/393 |

FOREIGN PATENT DOCUMENTS

| | | | |
|---|---|---|---|
| EP | 1 741 658 | A1 | 1/2007 |
| JP | 54 06747 | A | 5/1979 |
| JP | 07 315717 | A | 12/1995 |
| JP | 10 279233 | A | 10/1998 |
| JP | 11171425 | A * | 6/1999 |
| JP | 11 343082 | A | 12/1999 |
| WO | WO 2007144456 | A1 * | 12/2007 |

* cited by examiner

*Primary Examiner* — Jonathan Salata

(74) *Attorney, Agent, or Firm* — Ladas & Parry LLP

(57) ABSTRACT

A lift drive unit has at least one monitoring device for monitoring unallowed raising of a lift cage. The drive unit has a motor unit and a deflecting unit. If a counterweight supported by the deflecting unit, for example rests on a shaft pit buffer, the deflecting unit is unloaded and is raised by way of a spring element of the monitoring device. A sensor of the monitoring device detects the movement of the deflecting unit and switches off the motor of the drive unit via a safety circuit.

6 Claims, 3 Drawing Sheets

LIFT CABLE SLACK MONITORING DEVICE AND METHOD

The invention relates to a lift, and to a method of monitoring a lift, in which a lift cage and a counterweight are movable in a lift shaft, wherein support means connect and support the lift cage and the counterweight and a drive unit drives the support means.

BACKGROUND OF THE INVENTION

If a counterweight is stuck in a lift shaft, or travels onto the buffer arranged in the lift shaft pit, the support means or cable at the counterweight side becomes loose or slack. The traction of the support means on the drive pulley can, however, nevertheless be sufficient for the drive unit to be able to raise an empty or only lightly-loaded lift cage. According to European Norm EN 81-1, paragraph 9.3 c), it should not be possible to raise an empty lift cage when a counterweight rests on the buffer. Through raising of the lift cage dangerous situations could arise in which the traction between the support means and drive pulley is no longer sufficient and the lift cage would then drop back or crash. In the opposite running direction, raising of the counterweight is also not desired.

The risk of raising the lift cage or the counterweight exists, particularly when belts or synthetic fibre cables serve as support means with grippy running surfaces.

A hoisting cable monitoring means has become known from the specification in DD 290 399 A5 in which the hoisting cable is led through an eye-shaped contact frame. If the cable is loose or slack an electric switching-off of the drive is carried out by means of the contact frame. Such a construction, however, is not feasible in all lifts.

It is accordingly a purpose of the present invention to provide a simplified mechanism for modernizing a lift installation and providing a monitoring capability. A drive unit may be easily exchanged for a drive of the present invention. In addition, a safety device for monitoring the support means for slackness or unallowed raising of the lift cage or the counterweight can be installed at the same time.

BRIEF DESCRIPTION OF THE INVENTION

The invention fulfils the object of creating a lift, and a method of monitoring such a lift, which prevents unallowed raising of the lift cage or the counterweight. With the monitoring of the support means for slackness in accordance with the invention, no risky states can arise in extreme situations. As soon as a vertical load, produced by the lift cage and the counterweight, at the drive unit diminishes, the drive unit rises. The vertical movement of the drive unit is electrically or electronically monitored. As soon as the drive unit is raised by the reduction in load, a switching-off of the drive motor takes place. The monitoring device according to the invention is usable regardless of the type of drive unit. A spring element preferably provides the raising force for the drive unit.

The invention accordingly may be characterized as a lift with a lift cage and a movable and a counterweight movable in the lift shaft, with support means connecting and supporting the lift cage and the counterweight. A drive unit drives the support means. At least one spring element acting as a force store is provided at the drive unit and raises the drive unit when the support means is unloaded. At least one sensor detects raising of the drive unit and switches off the motor of the drive unit.

BRIEF DESCRIPTION OF THE DRAWINGS

The present invention is explained in more detail in the following detailed description of an illustrative embodiment, in considered in connection with the accompanying figures, in which.

DETAILED DESCRIPTION OF THE INVENTION

Figure 1:
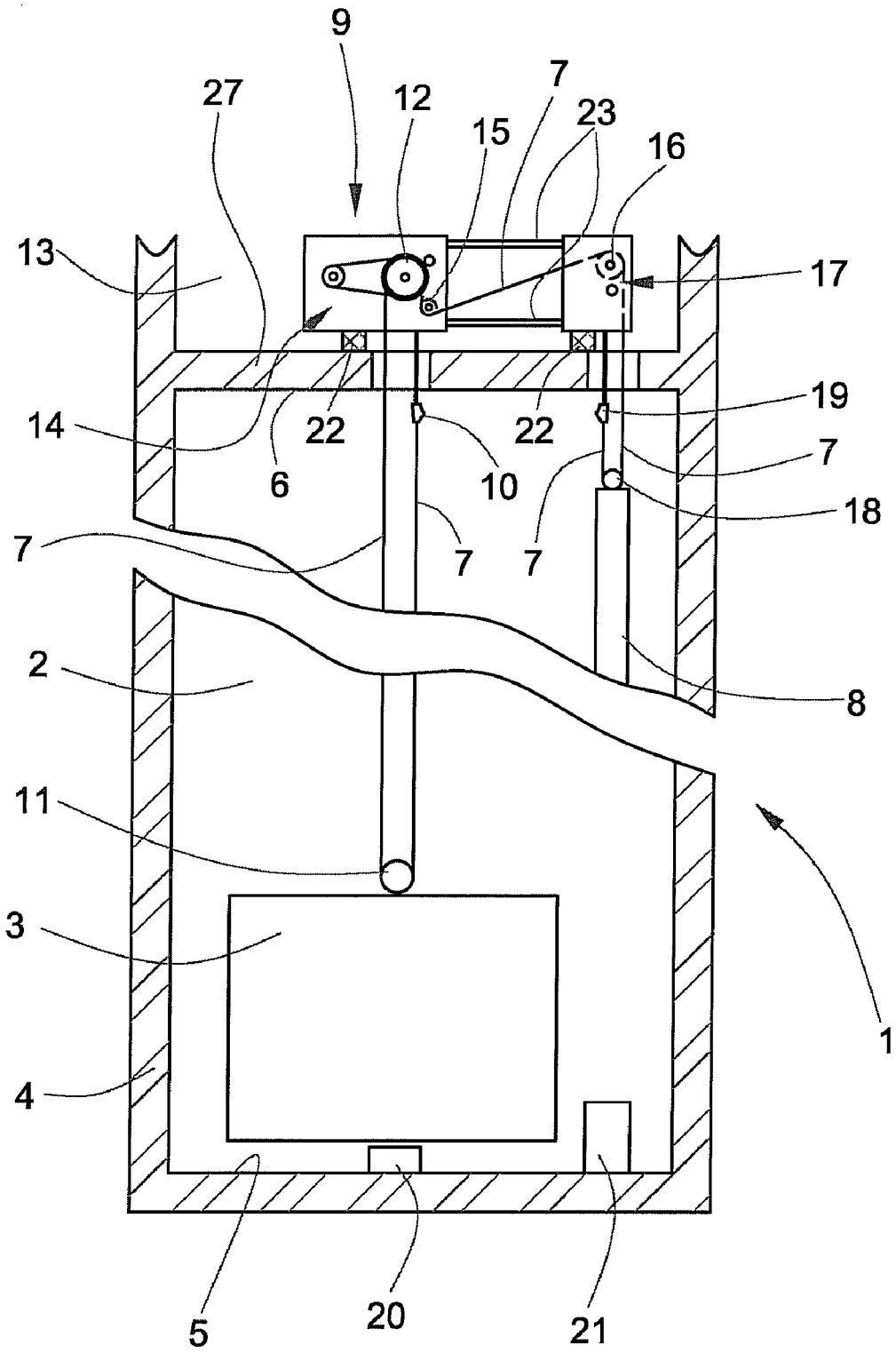
FIG. 1 is a diagrammatic view of a lift with a lift cage, counterweight and drive unit with which the present invention can be used.

FIG. 1 shows a lift 1 with a lift cage 3 movable in a lift shaft 2. The lift shaft 3 is bounded by shaft walls 4, a shaft pit 5 and a shaft ceiling 6. Support means 7 support and connect the lift cage 3 with a counterweight 8 movable in a lift shaft 2. Not illustrated are guide rails for the lift cage 3 and the counterweight 8 as well as building stories with lift entrances/exits. A drive unit 9, supported in an engine room 13 on spring elements 22 acting as a force store, drives the lift cage 3 and the counterweight 8, wherein the spring elements 22 rest on a constructional body 27. The drive unit 9 can also be arranged on pedestals of the constructional body 27, which support the spring elements 22. The drive unit 9 consists of a motor unit 14 and a deflecting unit 17, wherein the two units 14, 17 are connected by means of spacers 23.

Support means 7 may comprise at least one steel cable, synthetic fibre cable, flat belt, cogged belt, longitudinally ribbed belt or wedge-ribbed belt. The support means 7 is made fast at one end to a first support means fixing point 10, then led over a first deflecting roller 11 of the lift cage 3, then over a drive pulley 12 of the motor unit 14, then over a deflecting roller 15 of the motor unit 14, then over a second deflecting roller 16 of the deflecting unit 17 and then over a third deflecting roller 18 of the counterweight 8 and made fast at its other end to a second support means fixing point 19. The illustrated support means guidance has a 2:1 translation, in which the lift cage 3 and the counterweight 8 move vertically by half a meter when a meter of support means 7 is moved at the drive pulley 12. Other translation ratios such as, for example, 1:1 are also possible. A first buffer 20 for the lift cage 3 and a second buffer 21 for the counterweight 8 are provided in the shaft pit 5.

Figure 2:
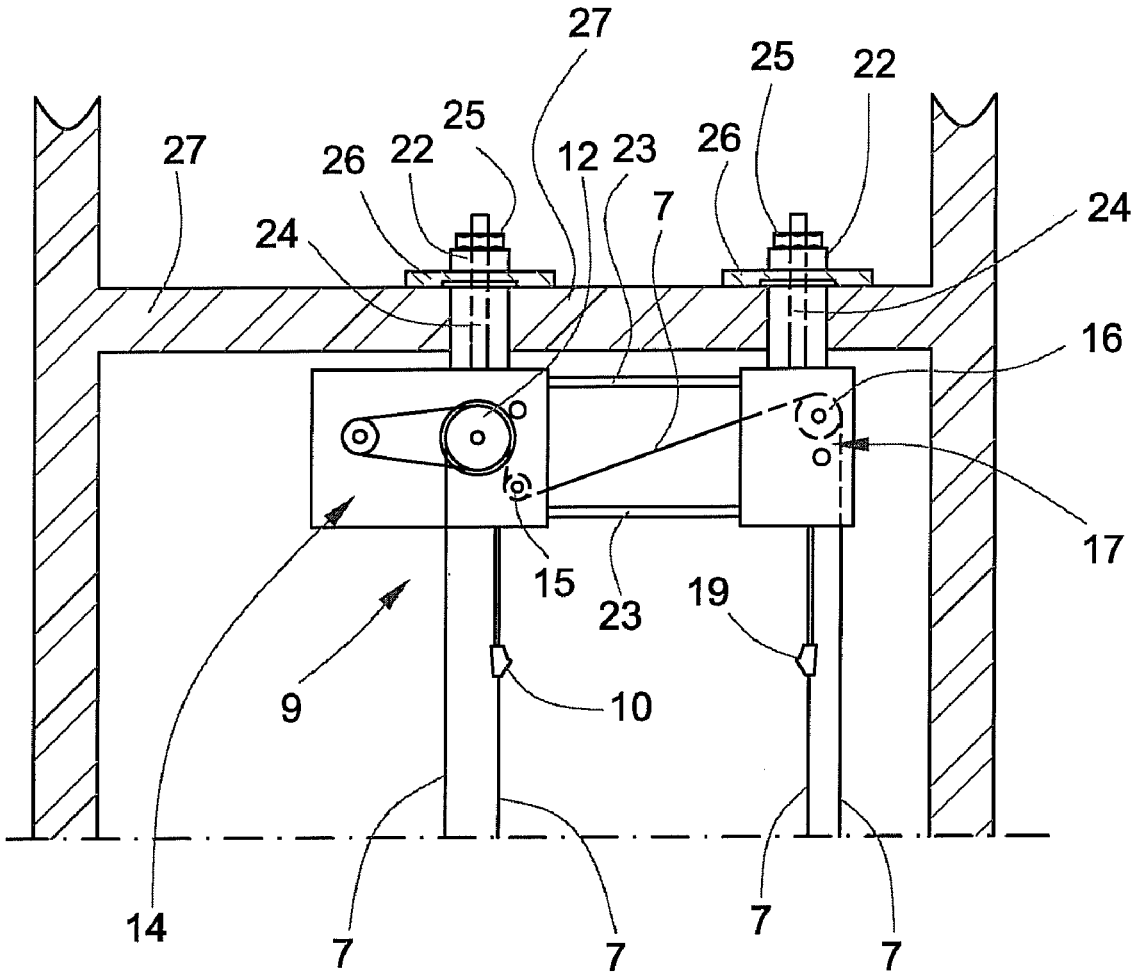
FIG. 2 is a diagrammatic view of a suspended drive unit for use in accordance with the invention.

FIG. 2 shows a variant arrangement of the drive unit 9. The drive unit 9 is suspended at the shaft ceiling 6, by load-bearing bolts 24. The load-bearing bolts 24 are supported upon spring elements 22 by means of nuts 25 resting on the springs. The spring elements 22 are in turn supported on plates 26 which rest on the constructional body 27.

Figure 3:
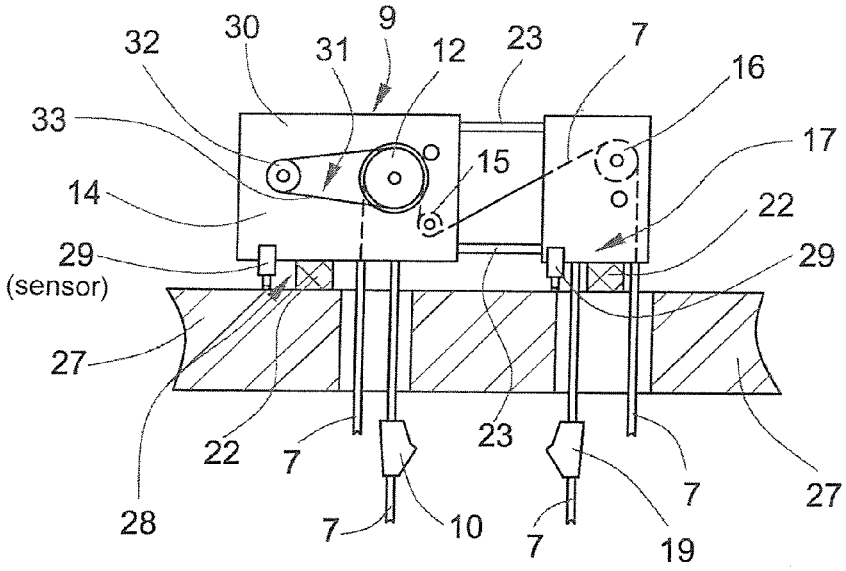
FIG. 3 shows a drive unit of the type depicted in FIG. 1 with a monitoring device according to the invention.

FIG. 3 shows the drive unit 9 with a monitoring device 28 according to the invention for monitoring the unallowed raising of the lift cage 3. The motor unit 14 of the drive unit 9 consists of a motor 30 which drives the drive pulley 12 by means of belt reduction gearing 31 consisting of pulley 32 and belt 33. The monitoring device 28 consists of at least one spring element 22 acting as a force store and at least one sensor 29, which detects a spacing change between the drive unit 9 and the constructional body 27 or raising of the drive unit 9.

Figure 4:
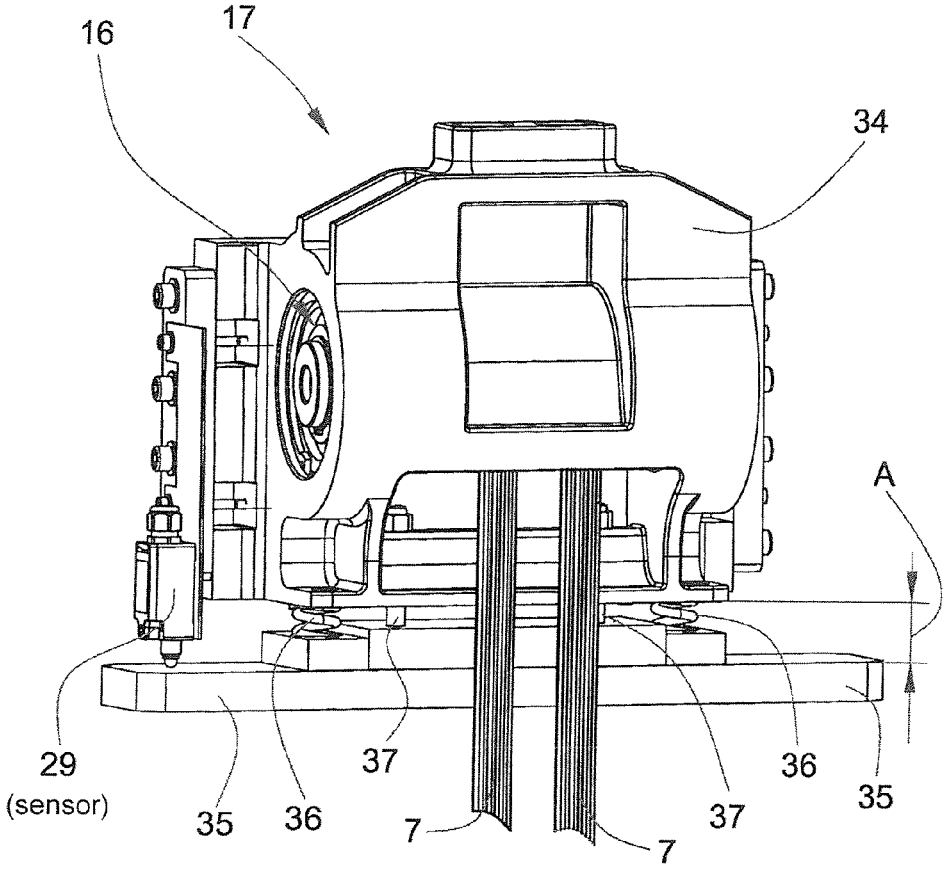
FIG. 4 shows a variant of a deflecting unit with the monitoring device according to the invention.

FIG. 4 shows a variant of the deflecting unit 17 with the monitoring device 28 according to the invention. The second deflecting roller 16 is enclosed and supported by a housing 34. At least two compression springs 36, acting as spring elements 22 and as a force store, are provided between a bracket 35 and the housing 34. Two belts which carry the counterweight 8 are provided as support means 7. Depending on the respective loading or relief of the support means 7 based on the respective support means load, the compression springs 36 compress to a greater or lesser extent. In normal operation the compression springs 36 are compressed to the greatest extent and the spacing A between the housing 34 and bracket 35 is the smallest. If the support means load is smaller, the compression springs 36 relax and the spacing A increases and the deflecting unit 17 is raised. If, for example, the counterweight 8 lies on the second buffer 21, the compression springs 36 completely relax; the spacing A is greatest and the deflecting unit 17 is raised to the maximum extent. The maximum compression and the minimum spacing A is limited by means of adjustable abutments 37. The abutment 37 can, for example, consist of a threaded pin which is screwed into a thread arranged at the housing and which is secured by means of a locknut.

The change in the spacing A can be monitored by means of the sensor 29 arranged at the side of the housing 34. For example, an electromechanical limit switch can be provided, which switch is set to a maximum compression of the compression springs 36 and which, in the case of spring relaxation, changes its switching state at, for example, 8 millimeters. The switch contact is usually connected in the safety circuit of the lift. If the compression springs 36 relax or the housing 34 is raised, the motor 30 of the drive unit 9 is switched off via the safety circuit. An inductive proximity switch, for example, can also be provided as a sensor, which switch setting is set to the maximum compression of the compression springs 36 and which, in the case of relaxation, changes its switching state, interrupts the safety circuit, and switches off the motor 30 of the drive unit 9.

In the embodiment of FIG. 4 the compression springs 36 are arranged between the housing 34 and bracket 35. In an alternative embodiment at least one compression spring 36 can be arranged on each side of the housing 34, wherein the compression springs 36 are supported at one end at an arm arranged at the housing 34 and at the other end at the bracket 35. The change in the spacing A can be monitored by means of the sensor 29 arranged at the side of the housing 34.

As shown in FIG. 3, the monitoring device 28 which detects resting of the lift cage 3 can also be provided at the motor unit 14. In the case of a suspended drive unit 9 as shown in FIG. 2, it is also possible to provide a monitoring device 28 which, for example, detects movement of the load-bearing bolt 24 relative to the plate 26, wherein the spring element 22 is constructed as a compression spring. The monitoring device 28 according to the invention is usable for any form of drive unit.

In the illustrated embodiments of a drive unit 9 with a motor unit 14 and a deflecting unit 17 the total compression force (TSF) for both compression springs 36 of the deflecting unit 17 is calculated as follows:

$$TSF=(WDP+(NTM\cdot WTM\cdot LTM))\cdot g,$$

wherein

WDP=mass of the drive unit 9 on the side of the deflecting unit 17, for example 40 to 100 kg WTM=mass of the support means 7 per meter, for example 200 to 600 g NTM=number of support means 7, for example 2 to 12

LTM=maximum length of the support means 7, for example 60 meters $g=9.81\ m/s^2$.

When the counterweight 8 is resting on the buffer 21, TSF=1000 N for

WDP=42 kg

WTM=0.25 kg

NTM=4

LTM=60 m

I claim:

1. An apparatus for monitoring the slack of lift support means driven by a drive unit and connecting and supporting a lift cage and a counterweight movable in a lift shaft, comprising at least one spring element acting as a force store and for raising the drive unit from a position corresponding to a loading of the support means when the support means is unloaded at the drive unit and at least one sensor for detecting the raising of the drive unit and for switching off the motor of the drive unit when the raising exceeds a set distance.

2. A lift according to claim 1, characterized in that the at least one spring element is a compression spring for providing a lifting force for the drive unit.

3. A lift according to claim 1, characterized in that the sensor is a limit switch which monitors raising of the drive unit and switches off the motor of the drive unit by way of a safety circuit of the lift.

4. A lift according to claim 1, 2 or 3, characterized in that the at least one spring element and sensor are arranged at least one of a motor unit and a deflecting unit of the drive unit.

5. A lift according to claim 2, characterized in that the at least one of the deflecting unit and a total compression force (TFS) the at least one compression spring is (WDP+(NTM·WTM·LTM))·g, wherein WDP=mass of the drive unit on the side of the deflecting unit, WTM=mass of the support means per meter, NTM=number of support means, LTM=maximum length of the support means, and $g=9.81\ m/s^2$.

6. A method of monitoring the slack in support means of a lift with a lift cage and a counterweight movable in a lift shaft, wherein the support means connects and supports the lift cage and the counterweight and a drive unit drives the support means, comprising the steps of monitoring the vertical position of the drive unit for a raising caused by a reduction in support means load and switching off the drive unit when the drive unit raising exceeds a set value.

* * * * *